US011199356B2

(12) United States Patent
Kopko et al.

(10) Patent No.: US 11,199,356 B2
(45) Date of Patent: Dec. 14, 2021

(54) FREE COOLING REFRIGERATION SYSTEM

(75) Inventors: William L. Kopko, Jacobus, PA (US); Mustafa K. Yanik, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 119 days.

(21) Appl. No.: 13/388,262

(22) PCT Filed: Aug. 12, 2010

(86) PCT No.: PCT/US2010/045313
§ 371 (c)(1),
(2), (4) Date: Jan. 31, 2012

(87) PCT Pub. No.: WO2011/019909
PCT Pub. Date: Feb. 17, 2011

(65) Prior Publication Data

US 2012/0125023 A1 May 24, 2012

Related U.S. Application Data

(60) Provisional application No. 61/233,994, filed on Aug. 14, 2009.

(51) Int. Cl.
*F25D 16/00* (2006.01)
*F25B 25/00* (2006.01)

(52) U.S. Cl.
CPC ..... *F25D 16/00* (2013.01); *F25B 25/005* (2013.01); *F25B 2400/06* (2013.01)

(58) Field of Classification Search
CPC ..... F25B 25/005; F25B 2313/003; F25B 2313/02531; F25B 5/00; F25B 7/00;
(Continued)

(56) References Cited

U.S. PATENT DOCUMENTS 3,276,516 A * 10/1966 Japhet ..... F24F 11/30 165/221
3,636,721 A * 1/1972 Rex ..... 62/98
(Continued)

FOREIGN PATENT DOCUMENTS

DE 3130390 2/1983
EP 0911156 4/1999
(Continued)

OTHER PUBLICATIONS

International Search Report dated Jan. 25, 2011 for PCT/US2010/045313.

(Continued)

*Primary Examiner* — Harry E Arant
(74) *Attorney, Agent, or Firm* — Fletcher Yoder, P.C.

(57) ABSTRACT

A refrigeration system includes a chiller with an integrated free cooling system and refrigeration system. In certain embodiments, the chiller may be a single package unit with all equipment housed within the same support frame. The chiller may generally include three modes of operation: a first mode that employs free cooling, a second mode that employs free cooling and implements a refrigeration cycle, and a third mode that uses the free cooling system provide additional cooling capacity for the refrigeration system. The free cooling system includes an independent loop configured to transfer heat from a cooling fluid circulating within the free cooling system to the ambient air.

16 Claims, 4 Drawing Sheets

(58) Field of Classification Search
CPC ..... F25B 41/00; F25B 25/00; F25B 40/00; F25B 40/02; F25B 2600/13; F25D 16/00
USPC .... 62/99, 113, 196.4, 79, 117, 98, 175, 333, 62/335; 165/104.14, 141, 140
See application file for complete search history.

(56) References Cited

U.S. PATENT DOCUMENTS 4,277,952 A * 7/1981 Martinez, Jr. ..... F24F 5/001 62/115
4,406,138 A * 9/1983 Nelson ..... 62/305
4,495,777 A * 1/1985 Babington ..... F25D 17/02 165/299
4,796,439 A * 1/1989 Yamada et al. ..... 62/159
4,926,649 A * 5/1990 Martinez, Jr. ..... 62/99
4,932,221 A * 6/1990 Shimizu ..... F25B 7/00 62/180
4,955,585 A * 9/1990 Dickerson ..... 261/26
5,081,848 A 1/1992 Rawlings
5,727,393 A * 3/1998 Mahmoudzadeh ..... F25D 17/02 62/156
5,875,637 A * 3/1999 Paetow ..... 62/117
5,921,092 A * 7/1999 Behr ..... A47F 3/0482 62/155
5,970,729 A 10/1999 Yamamoto et al.
6,536,231 B2 * 3/2003 Gupte ..... 62/524
6,640,561 B2 11/2003 Roberto
7,036,330 B2 5/2006 Grabon et al.
2008/0092573 A1 4/2008 Vaisman et al.
2009/0008074 A1 * 1/2009 Vamvakitis et al. ..... 165/177

FOREIGN PATENT DOCUMENTS

EP 1533116 5/2005
EP 1855070 11/2007
GB 2145217 3/1985
JP S57115681 A * 7/1982 ..... F28C 1/12
JP 10300265 11/1998
JP 2004132651 4/2004
WO 8103062 10/1981
WO WO 8103062 A1 * 10/1981
WO 0165188 9/2001
WO 2008045039 4/2008
WO 2008045040 4/2008
WO 2008045084 4/2008
WO 2008045086 4/2008
WO WO 2008045039 A1 * 4/2008
WO 2008061297 5/2008
WO 2008061960 5/2008
WO 2008063256 5/2008
WO 2008105763 5/2008
WO 2008105868 9/2008

OTHER PUBLICATIONS

Office Action and Search Report dated Jan. 6, 2014 in counterpart Chinese Application No. 201080042555.2.

* cited by examiner

FREE COOLING REFRIGERATION SYSTEM

BACKGROUND

The invention relates generally to free cooling refrigeration systems.

Many applications exist for refrigeration systems including residential, commercial, and industrial applications. For example, a commercial refrigeration system may be used to cool an enclosed space such as a data center, laboratory, supermarket, or freezer. Very generally, refrigeration systems may include circulating a fluid through a closed loop between an evaporator where the fluid absorbs heat and a condenser where the fluid releases heat. The fluid flowing within the closed loop is generally formulated to undergo phase changes within the normal operating temperatures and pressures of the system so that considerable quantities of heat can be exchanged by virtue of the latent heat of vaporization of the fluid.

Refrigeration systems may operate with a free cooling system or loop when ambient temperatures are low. The free cooling system may exploit the low temperature of the ambient air to provide cooling without the need for an additional energy input from, for example, a compressor, a thermoelectric device, or a heat source. Typically, free cooling systems may employ a separate heat exchanger or portion of a heat exchanger coil when operating in a free cooling mode. When free cooling is not desired, or feasible, the separate heat exchanger or coil portion may not be utilized.

SUMMARY

The present invention relates to a refrigeration system that includes a free cooling system with a first circuit configured to transfer heat from a first cooling fluid to a second cooling fluid circulating within an independent loop of the free cooling system. The independent loop is configured to transfer heat from the second cooling fluid to ambient air. The refrigeration system also includes a heat exchanger configured to receive refrigerant and to transfer heat from the refrigerant to the second cooling fluid.

The present invention also relates to a refrigeration system with a vapor-compression refrigeration system. The vapor-compression refrigeration system includes an evaporator configured to remove heat from a first cooling fluid circulating through a cooling loop and a free cooling system configured to circulate the first cooling fluid through a first circuit to exchange heat between the first cooling fluid and a second cooling fluid circulating through an independent loop of the free cooling system. The independent loop circulates the second cooling fluid through an air-to-liquid heat exchanger configured to transfer heat from the second cooling fluid to ambient air.

The present invention further relates to a method for operating a refrigeration system that includes operating a vapor-compression refrigeration system to remove heat from a first cooling fluid and circulating an isolated second cooling fluid within a free cooling system to remove heat from the vapor-compression refrigeration system.

DRAWINGS

DETAILED DESCRIPTION

Figure 1:
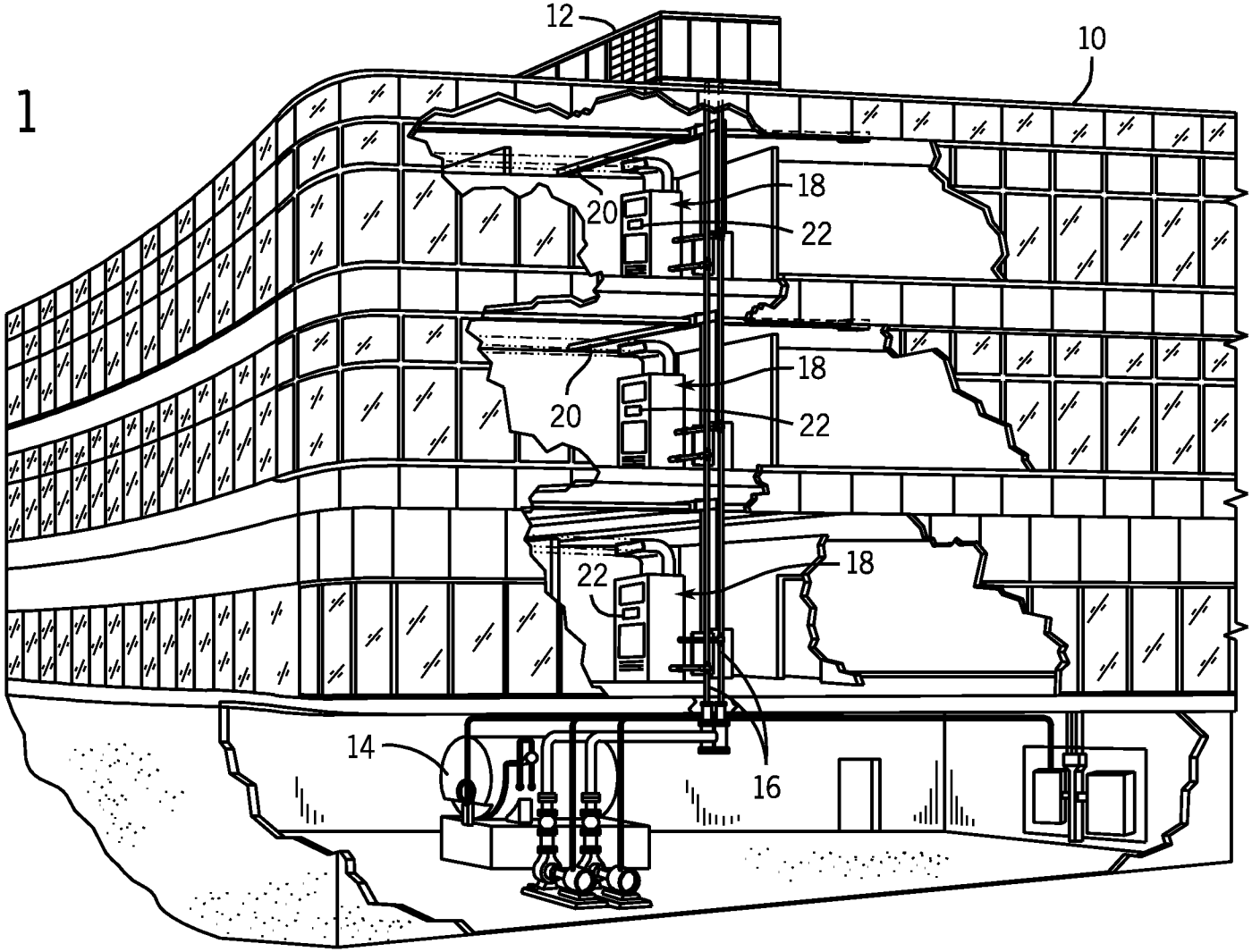
FIG. 1 is perspective view of an exemplary commercial or industrial environment that employs a free cooling refrigeration system.

FIG. 1 depicts an exemplary application for a refrigeration system. Such systems, in general, may be applied in a range of settings, both within the heating, ventilating, air conditioning, and refrigeration (HVAC&R) field and outside of that field. The refrigeration systems may provide cooling to data centers, electrical devices, freezers, coolers, or other environments through vapor-compression refrigeration, absorption refrigeration, or thermoelectric cooling. In presently contemplated applications, however, refrigeration systems may be used in residential, commercial, light industrial, industrial, and in any other application for heating or cooling a volume or enclosure, such as a residence, building, structure, and so forth. Moreover, the refrigeration systems may be used in industrial applications, where appropriate, for basic refrigeration and heating of various fluids.

FIG. 1 illustrates an exemplary application, in this case an HVAC&R system for building environmental management that may employ heat exchangers. A building 10 is cooled by a system that includes a chiller 12 and a boiler 14. As shown, chiller 12 is disposed on the roof of building 10 and boiler 14 is located in the basement; however, the chiller and boiler may be located in other equipment rooms or areas next to the building. Chiller 12 is an air cooled or water cooled device that implements a refrigeration cycle to cool water. Chiller 12 is housed within a single structure that includes a refrigeration circuit, a free cooling system, and associated equipment such as pumps, valves, and piping. For example, chiller 12 may be single package rooftop unit that incorporates a free cooling system. Boiler 14 is a closed vessel in which water is heated. The water from chiller 12 and boiler 14 is circulated through building 10 by water conduits 16. Water conduits 16 are routed to air handlers 18, located on individual floors and within sections of building 10.

Air handlers 18 are coupled to ductwork 20 that is adapted to distribute air between the air handlers and may receive air from an outside intake (not shown). Air handlers 18 include heat exchangers that circulate cold water from chiller 12 and hot water from boiler 14 to provide heated or cooled air. Fans, within air handlers 18, draw air through the heat exchangers and direct the conditioned air to environments within building 10, such as rooms, apartments or offices, to maintain the environments at a designated temperature. A control device, shown here as including a thermostat 22, may be used to designate the temperature of the conditioned air. Control device 22 also may be used to control the flow of air through and from air handlers 18. Other devices may, of course, be included in the system, such as control valves that regulate the flow of water and pressure and/or temperature transducers or switches that sense the temperatures and pressures of the water, the air, and so forth. Moreover, control devices may include computer systems that are integrated with or separate from other building control or monitoring systems, and even systems that are remote from the building.

Figure 2:
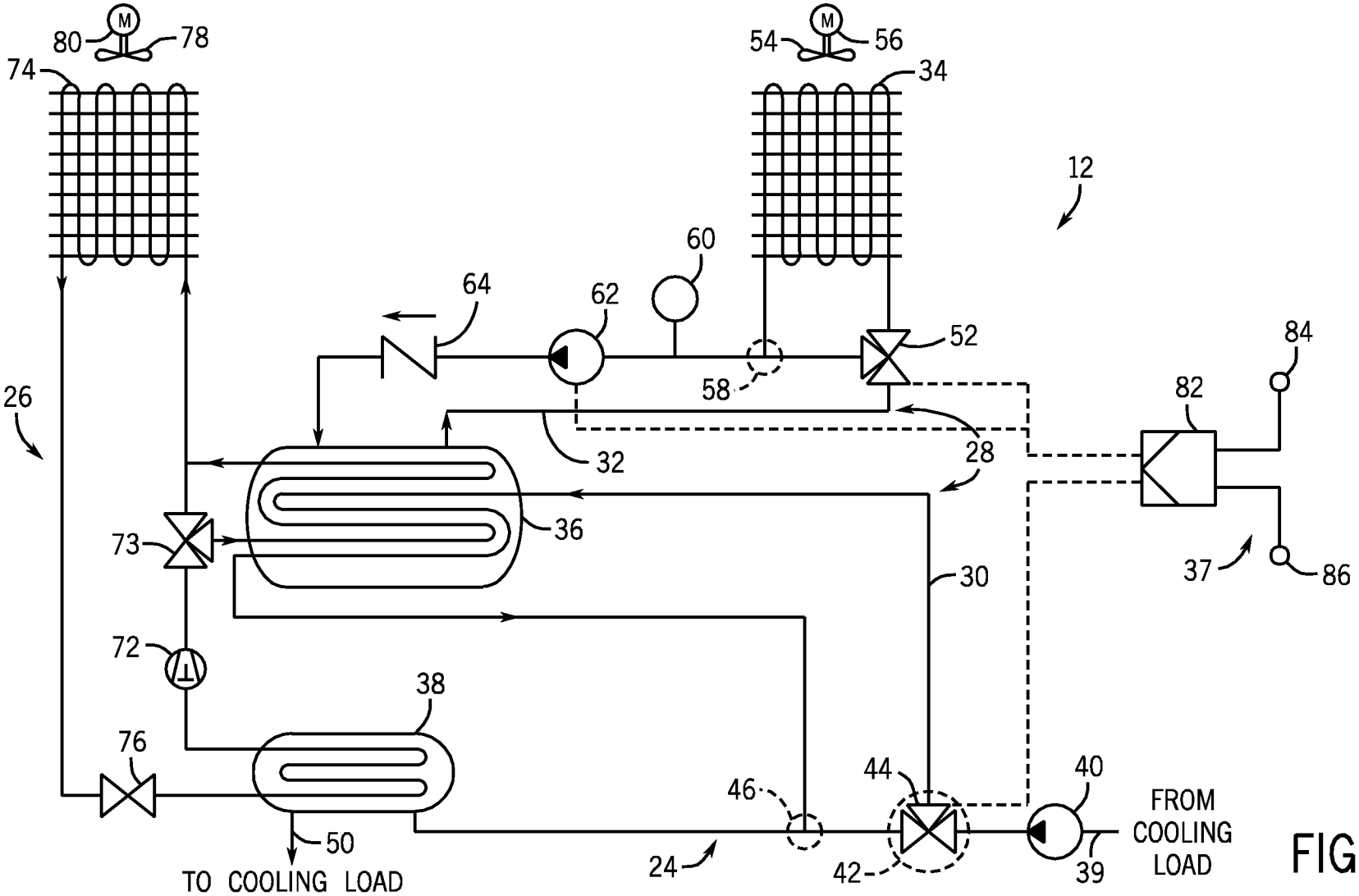
FIG. 2 is a diagrammatical overview of an embodiment of a free cooling refrigeration system employing a three-fluid heat exchanger.

FIG. 2 schematically illustrates chiller 12, which incorporates a free cooling system. As noted above with respect to FIG. 1, chiller 12 is housed within a single structure and may be located outside of a building or environment, for example on a roof top. Chiller 12 includes a cooling fluid loop 24 that circulates a cooling fluid, such as chilled water, an ethylene glycol-water solution, brine, or the like, to a cooling load, such as a building, piece of equipment, or environment. For example, cooling fluid loop 24 may circulate the cooling fluid to water conduits 16 shown in FIG. 1. In certain embodiments, the cooling fluid may circulate within the cooling fluid loop 24 to a cooling load, such as a research laboratory, computer room, office building, hospital, molding and extrusion plant, food processing plant, industrial facility, machine, or any other environments or devices in need of cooling. Chiller 12 also includes a refrigeration system loop 26. Refrigeration system loop 26 is in heat transfer communication with cooling fluid loop 24 and may remove heat from the cooling fluid circulating within the cooling fluid loop 24.

Chiller 12 further includes a free cooling system 28 that exploits the low temperature of ambient air in order to cool the cooling fluid circulating within cooling fluid loop 24. Free cooling system 28 includes a circuit 30 configured to circulate the cooling fluid through free cooling system 28. Free cooling system 28 also includes an independent loop 32 that is configured to remove heat from free cooling system 28 to ambient air. Independent loop 32 may circulate a fluid through an air-to-liquid heat exchanger 34 that expels heat to the ambient air. Heat exchanger 34 may include a fin and tube heat exchanger, brazed aluminum multichannel heat exchanger, or other suitable heat exchanger. Independent loop 32 allows the fluid exposed to the ambient air to be independent from the cooling fluid circulating within cooling fluid loop 24. In general, the fluid circulating within independent loop 32 may have a lower freezing point temperature than the cooling fluid circulating within circuit 30. In certain embodiments, the fluid circulating within independent loop 32 may be a freeze-protected fluid, such as brine with a high glycol concentration, to inhibit freezing during periods of low ambient temperatures. However, freeze-protected fluids may have a higher cost, higher viscosity (which may result in increased pumping power), and/or a lower heat transfer rate when compared to other cooling fluids, such as water. By circulating the freeze-protected fluid through a relatively small and independent loop 32, a relatively small amount of freeze-protected fluid may be employed, which in turn may improve efficiency of chiller 12 and/or reduce costs. Moreover, a chiller 12 with a free cooling system employing independent loop 32 may be added to an existing chiller application without retrofitting existing equipment currently sized for another cooling fluid, such as water.

Independent loop 32 also may circulate the freeze-protected fluid through a heat exchanger 36 that receives three separate fluids. Specifically, heat exchanger 36 may receive the freeze-protected fluid circulating within independent loop 32, the cooling fluid circulating within circuit 30, and the refrigerant circulating within refrigeration system loop 26. In certain embodiments, heat exchanger 36 may include a heater (i.e. an electric heater or other suitable heater) to inhibit freezing of the cooling fluid flowing through heat exchanger 36.

Chiller 12 may operate in three different modes of operation depending on the requirements of the cooling load and the temperature of the ambient air. Specifically, a control device 37 may govern operation of chiller 12 to cool the fluid within the cooling fluid loop 24 to a prescribed temperature or prescribed range of temperatures. For example, control device 37 may switch chiller 12 between the three different modes of operation.

When the outside air temperature is low, for example, during winter in northern climates, chiller 12 may operate in a free cooling mode that directs the cooling fluid through free cooling system 28 before returning the fluid to the cooling load. In this mode of operation, free cooling system 28 may transfer heat from the cooling fluid to the freeze-protected fluid circulating within independent loop 32. Independent loop 32 may circulate the freeze-protected fluid through air-to-liquid heat exchanger 34 to expel the heat to the low temperature outdoor air.

If additional cooling capacity is desired or needed, chiller 12 may operate in a second mode of operation that employs mechanical cooling, in addition to the free cooling provided by free cooling system 28. During mechanical cooling, refrigeration system 26 may implement a vapor-compression cycle to provide additional cooling for the cooling fluid. For example, in this mode of operation, the cooling fluid may first be cooled by the freeze-protected fluid as the cooling fluid circulates through circuit 30. Specifically, as the cooling fluid flows through heat exchanger 36, the cooling fluid may transfer heat to the freeze-protected fluid flowing through heat exchanger 36 from independent loop 32. After exiting free cooling system 28, the cooling fluid may undergo further cooling by transferring heat to a refrigerant flowing within refrigeration system loop 26. Specifically, as the cooling fluid flows through an evaporator 38, the cooling fluid may transfer heat to the refrigerant flowing within refrigeration system 26.

To provide even more cooling capacity, chiller 12 may operate in a third mode of operation that employs refrigeration system 26 and independent loop 32 of the free cooling system 28 to supplement cooling of refrigerant in refrigeration system 26. In this mode of operation, the cooling fluid that circulates to the cooling load may be cooled by refrigerant flowing within refrigeration system 26 as the cooling fluid flows through evaporator 38. Instead of first flowing through free cooling system 28, the cooling fluid may bypass free cooling system 28 and flow directly to evaporator 38. The free cooling system 28 may then be used to cool the refrigerant flowing within refrigeration system 26. Specifically, the refrigerant may flow through heat exchanger 36 to transfer heat to the freeze-protected fluid within independent loop 32. The freeze-protected fluid may then transfer heat to the ambient air as the freeze-protected fluid flows through air-to-liquid heat exchanger 34. In this manner, the free cooling system 28 may absorb heat from the refrigerant flowing within refrigeration system 26 to provide additional cooling capacity.

Regardless of the mode of operation, chiller 12 may function to cool the cooling fluid circulating to and from the cooling load. The cooling fluid may enter chiller 12 through a return line 39 that is in fluid communication with the cooling load. A pump 40 circulates the cooling fluid through cooling fluid loop 24 and directs the cooling fluid to a connection point 42 that fluidly connects free cooling system 28 to cooling fluid loop 24. The pump may be any suitable type of pump such as a positive displacement pump, centrifugal pump, or the like. A valve 44 may be located at connection point 42 and may direct the cooling fluid to free cooling system 28. In certain embodiments, valve 44 may be a three-way servo controlled valve configured to direct cooling fluid through the free cooling system 28 in one position and to bypass the free cooling system 28 in another position. However, in other embodiments, valve 44 may be a ball valve, rotor valve or the like controlled by electromechanical actuators, pneumatic actuators, hydraulic actuators, or other suitable controls.

The chiller 12 may operate in the first mode, or free cooling mode, of operation when the ambient air temperature is sufficiently low enough to provide free cooling. For example, chiller 12 may operate in the free cooling mode during the winter when outside temperatures are below approximately 13 degrees Celsius. However, in other embodiments, the cooling mode determination may depend on a variety of factors such as the cooling requirement of the cooling load, the outside temperature and/or humidity, the type of cooling fluid, and the cooling capacity of the chiller 12 among other things. In the first mode, valve 44 may direct the cooling fluid through circuit 30 of free cooling system 28. Pump 40 may circulate the cooling fluid through circuit 30 to heat exchanger 36. However, in certain embodiments, an additional pump may be included within circuit 30 to circulate the cooling fluid through free cooling system 28.

As the cooling fluid circulates through heat exchanger 36, the cooling fluid may transfer heat to the freeze-protected fluid also flowing through heat exchanger 36. Heat exchanger 36 includes a three-fluid heat exchanger that circulates the cooling fluid from circuit 30, the freeze-protected fluid from independent loop 32 and the refrigerant from refrigeration system 26. In certain embodiments, heat exchanger 36 may be a shell and tube heat exchanger with multiple circuits or a plate heat exchanger with multiple circuits. For example, heat exchanger 36 may include two separate circuits, one for the cooling fluid circulating within circuit 30 and one for the refrigerant circulating within refrigeration system loop 26. The freeze-protected fluid from independent loop 32 may then flow through the shell side in a shell and tube heat exchanger or through the portion of a plate heat exchanger that is in heat transfer communication with both circuits.

In certain modes of operation, only two fluids may circulate through heat exchanger 36. For example, in the first mode of operation, only the freeze-protected fluid and the cooling fluid may circulate through heat exchanger 36. Because refrigeration system 26 does not operate in the first mode of operation, no refrigerant may circulate through heat exchanger 36. However, heat exchanger 36 may act as a receiver for the refrigerant in the first mode of operation.

In the first mode of operation, the cooling fluid may transfer heat to the freeze-protected fluid as the cooling fluid flows through heat exchanger 36. The cooling fluid may then exit heat exchanger 36 as a lower temperature fluid and may return to cooling fluid loop 24 through connection point 46. The cooling fluid may then circulate within cooling loop 24 to evaporator 38. In this first mode of operation, evaporator 38 may function as a reservoir without providing any substantial evaporating cooling of the cooling fluid. From evaporator 38, the cooling fluid may return to the cooling load through a supply line 50. Supply line 50 may circulate the cooling fluid to the cooling load where the cooling fluid may be heated by the cooling load. For example, the cooling fluid may absorb heat from air within a building or from a fluid flowing within a device. After receiving heat from the cooling load, the cooling fluid may enter chiller 12 through return line 39 where the cooling cycle may begin again.

In this first mode of operation, the freeze-protected fluid may absorb heat from the cooling fluid within heat exchanger 36. From heat exchanger 36, the freeze-protected fluid may circulate within independent loop 32 to a valve 52. In certain embodiments, valve 52 may be a three-way servo controlled valve configured to direct the freeze-protected cooling fluid through air-to-liquid heat exchanger 34 in one position and to bypass heat exchanger 34 in another position. However, in other embodiments, valve 52 may be a ball valve, rotor valve or the like controlled by electromechanical actuators, pneumatic actuators, hydraulic actuators, or other suitable controls.

Valve 52 may direct the freeze-protected fluid to heat exchanger 34 to expel some or all of the heat absorbed from the cooling fluid to ambient air. The cooling fluid may flow through tubes of heat exchanger 34 to transfer heat to the ambient air. A fan 54, which is driven by a motor 56, draws air across heat exchanger 34. As the air flows across heat exchanger 34, heat may transfer from the freeze-protected fluid to the air, thereby cooling the fluid, and producing heated air. Therefore, the temperature of the fluid exiting heat exchanger 34 may be less then the temperature of the fluid entering heat exchanger 34.

From heat exchanger 34, the freeze-protected fluid may flow through a connection point 58, an expansion tank 60, a pump 62, and a check valve 64 before returning to heat exchanger 36. Expansion tank 60 may allow for storage and thermal expansion of the freeze-protected fluid and may be any suitable type of tank or vessel. Pump 62 may include any suitable type of pump configured to circulate the freeze-protected fluid independent loop 32. Valve 64 may include a check valve that prevents the backward flow of cooling fluid through pump 62. However, in other embodiments, pump 62 may include a positive displacement pump with an integrated valve feature that prevents backwards flow. In this embodiment, valve 64 may be omitted. Further, in other embodiments, valve 64 may be a manually actuated valve, solenoid valve, gate valve, or other suitable type of valve. From valve 64, the cooling fluid may enter heat exchanger 36 where it may again absorb heat from the cooling fluid.

Control devices 37 may govern operation of valve 52, pump 62, and/or motor 56 to control the temperature of the freeze-protected fluid entering heat exchanger 36. For example, in certain embodiments, the temperature of the freeze-protected fluid entering heat exchanger 36 may be maintained at a certain temperature above freezing to inhibit freezing of the cooling fluid also circulating within heat exchanger 36. In a specific example, control devices 37 may turn off motor 56 that drives fan 54 to cease airflow through air-to-liquid heat exchanger 34, which in turn may increase the temperature of the freeze-protected fluid entering heat exchanger 36. In another example, control devices 37 may set valve 52 to a bypass position where the freeze-protected fluid flows directly from heat exchanger 36 to expansion tank 60, bypassing air-to-liquid heat exchanger 34. In yet another example, control devices 37 may engage and disengage pump 62. Control devices 37 may govern operation of motor 56, valve 52, and/or pump 62 based on ambient air temperature, temperature of the freeze-protected fluid, temperature of the cooling fluid, time of day, operating times, calendar days, or combinations thereof, among others.

Chiller 12 may operate in a second mode of operation when the outside air temperature has increased and/or when the outside air temperature is not cool enough to provide adequate cooling to the cooling load. In the second mode of operation, refrigeration system 26 may implement a vapor-compression cycle, or other type of cooling cycle, such as absorption or a thermoelectric cycle, to provide additional cooling for the cooling load. The cooling fluid may flow through circuit 30 of free cooling system 28 as previously described with respect to the first mode of operation. Specifically, as the cooling fluid flows through heat exchanger 36, the cooling fluid may transfer heat to the freeze-protected fluid circulating within independent loop 32 of free cooling system 28. The cooling fluid, after being cooled by the freeze-protected fluid, may flow through connection point 46 and re-enter fluid cooling loop 24.

The cooling fluid may then flow into evaporator 38 where it may be cooled by refrigerant from refrigeration system 26. Evaporator 38 may be a plate heat exchanger, a shell and tube heat exchanger, a plate and shell heat exchanger, or any other suitable type of heat exchanger. Evaporator 38 may circulate refrigerant flowing within a closed loop of refrigeration system 26. The refrigerant may be any fluid that absorbs and extracts heat. For example, the refrigerant may be a hydrofluorocarbon (HFC) based R-410A, R-407C, or R-134a, or it may be carbon dioxide (R-744) or ammonia (R-717). As the refrigerant flows through evaporator 38, the refrigerant may absorb heat from the cooling fluid flowing within evaporator 38 to cool the cooling fluid before the cooling fluid returns to the cooling load through supply line 50.

Within refrigeration system 26, the refrigerant may circulate through a closed loop including a compressor 72, heat exchanger 36, a condenser 74, and an expansion device 76. In operation, the refrigerant may exit evaporator 38 as a low pressure and temperature vapor. Compressor 72 may reduce the volume available for the refrigerant vapor, consequently, increasing the pressure and temperature of the vapor refrigerant. The compressor may be any suitable compressor, such as a screw compressor, reciprocating compressor, rotary compressor, swing link compressor, scroll compressor, or centrifugal compressor. Compressor 72 may be driven by a motor that receives power from a variable speed drive or a direct AC or DC power source. From compressor 72, the high pressure and temperature vapor refrigerant may flow through heat exchanger 36. As the refrigerant flows through heat exchanger 36, the refrigerant may transfer heat to the freeze-protected fluid flowing within heat exchanger 36 from independent loop 32. Consequently, the freeze-protected fluid may absorb heat from both the cooling fluid circulating within circuit 30 and the refrigerant circulating within refrigeration system loop 26. In certain embodiments, the freeze-protected fluid may desuperheat a portion of or all of the refrigerant flowing through heat exchanger 36. However, in other embodiments, a bypass valve 73 may allow the refrigerant to bypass the heat exchanger 36 and flow directly to condenser 74 in the second mode of operation.

From heat exchanger 36 and/or bypass valve 73, the refrigerant vapor may flow to condenser 74. A fan 78, which is driven by a motor 80, draws air across the tubes of condenser 74. The fan may push or pull air across the tubes. As the air flows across the tubes, heat transfers from the refrigerant vapor to the air, causing the refrigerant vapor to condense into a liquid and heating the ambient air. The liquid refrigerant then enters an expansion device 76 where the refrigerant expands to become a low pressure and temperature liquid-vapor mixture. Typically, expansion device 76 will be a thermal expansion valve (TXV); however, according to other exemplary embodiments, the expansion device may be an electromechanical valve, an orifice, or a capillary tube. From expansion device 76, the liquid refrigerant may enter evaporator 38 where the process may begin again, and the refrigerant may absorb heat from the cooling fluid flowing through evaporator 38.

Refrigeration system 26 generally includes a high-pressure side and a low-pressure side. The high-pressure side includes the section of refrigeration system 26 that circulates the higher-pressure refrigerant (i.e., after compression and before expansion). Specifically, the high-pressure side includes the section that circulates the refrigerant from compressor 72 through heat exchanger 36, condenser 74, and expansion device 76. The low-pressure side includes the section of refrigeration system 26 that circulates the lower-pressure refrigerant (i.e., after expansion and before compression). Specifically, the low-pressure side includes the portion of refrigeration system 26 that circulates refrigerant from expansion valve 76 through evaporator 38 into compressor 72. In other embodiments, the refrigeration system 26 may not have a condenser 74. In these embodiments, the heat exchanger 36 may function as a condenser.

As described above, in the second mode of operation, the cooling fluid within cooling loop 24 may be cooled by both the free cooling system 28 and the refrigeration system 26. Specifically, the free cooling system 28 may circulate the cooling fluid through the first circuit 30 to transfer heat from the cooling fluid to the freeze-protected fluid circulating within independent loop 32. The freeze-protected fluid may then release the heat absorbed from the cooling fluid to ambient air as the freeze-protected fluid flows through air-to-liquid heat exchanger 34. After the cooling fluid has been cooled by the freeze-protected fluid within heat exchanger 36, the cooling fluid may then flow through evaporator 38 where refrigeration system 26 may further remove heat from the cooling fluid by absorbing heat from the cooling fluid into refrigerant flowing within evaporator 38. In this manner, both free cooling system 28 and the refrigeration system 26 may be used to provide cooling capacity during this second mode of operation.

When even further refrigeration or cooling capacity is desired, chiller 12 may operate in a third mode of operation employing supplemental cooling. In this mode, the cooling fluid may enter chiller 12 through return line 39, flow through pump 40, and through valve 44 at connection point 42. From valve 44, the cooling fluid may flow directly to connection point 46, bypassing free cooling system 28. From connection point 46, the cooling fluid may flow through evaporator 38 where it may be cooled by the refrigerant flowing through refrigeration system 26.

In this third mode of operation, refrigeration system 26 may receive supplemental cooling from the freeze-protected fluid flowing through heat exchanger 36. The freeze-protected fluid may flow through independent loop 32 of free cooling system 28 as previously described with respect to the first mode of operation. However, in this third mode of operation, as the freeze-protected fluid flows through heat exchanger 36, the freeze-protected fluid may absorb heat from the compressed refrigerant exiting compressor 72 and flowing through heat exchanger 36. In certain embodiments, heat exchanger 36 may function to desuperheat the compressed refrigerant before it enters condenser 74. By transferring heat from the refrigerant to the freeze-protected fluid flowing within independent loop 32 of free cooling system 28, heat exchanger 36 may provide additional cooling capacity for refrigeration system 26.

Accordingly, during the third mode of operation, heat exchanger 36 may be used to transfer heat from refrigeration system 26 to free cooling system 28. Specifically, independent loop 32 of free cooling system 28 may circulate the freeze-protected fluid from heat exchanger 36 to air-to-liquid heat exchanger 34 to expel the heat into the environment. In this manner, air-to-liquid heat exchanger 34 may be used by chiller 12 to remove heat from the system even when the system is not operating in a free cooling mode. For example, independent loop 32 may be used to remove heat from refrigeration system 26 even when environmental air temperatures may be higher then the chilled water supply temperature. Specifically, even though the ambient air temperature may be high, for example above 21 degrees Celsius, the ambient air temperature still may be lower than the temperature of the high pressure and temperature refrigerant flowing within the refrigeration system 26. This temperature difference may enable air-to-liquid heat exchanger 34 to transfer heat from refrigeration system 26 to the environment, thereby increasing the cooling capacity of refrigeration system 26.

Control devices 37, such as control circuitry 82 and temperature sensors 84 and 86, may govern operation of chiller 12. For example, control circuitry 82 may be coupled to valves 44 and 52 and pump 62. Control circuitry 82 may use information received from sensors 84 and 86 to determine when to operate pump 62 and when to switch positions of valves 44 and 52. In some applications, control circuitry 82 also may be coupled to motors 56 and 80, which drive fans 54 and 78, respectively. Further, control circuitry 82 may be coupled to compressor 72. Control circuitry 82 may include local or remote command devices, computer systems and processors, and/or mechanical, electrical, and electromechanical devices that manually or automatically set a temperature related signal that a system receives.

Control circuitry 82 may be configured to switch chiller 12 between the first, second, and third modes of operation based on input received from temperature sensors 84 and 86. Temperature sensor 84 may sense the temperature of the ambient outside air and temperature sensor 86 may sense the temperature of the cooling fluid returning from the cooling load. For example, temperature sensor 86 may be disposed within cooling loop 24. In certain embodiments, when the ambient air temperature sensed by sensor 84 is below the cooling fluid temperature sensed by temperature sensor 86, control circuitry 82 may set chiller 12 to operate in a first mode of operation that employs free cooling by circulating the cooling fluid through the circuit 30 of free cooling system 28. For example, control circuitry 82 may set valve 42 to direct cooling fluid through free cooling system 28, may engage pump 62, and may disable compressor 72. Control circuitry 82 may operate chiller 12 in the first mode of operation until the temperature of the ambient air reaches a specified value or is a certain amount above the temperature of the cooling fluid.

Control circuitry 82 may then set chiller 12 to operate in the second mode of operation that employs refrigeration system 26, in addition to circulating the cooling fluid through the circuit 30 of free cooling system 28. In certain embodiments, control circuitry 82 may enable compressor 72 and motor 80 to circulate refrigerant through refrigeration system 26. Control circuitry 82 may operate chiller 12 in the second mode of operation until the ambient air temperature reaches another specified value or amount above the cooling fluid temperature or until the cooling fluid temperature rises above a certain threshold. Further, in other embodiments, control circuitry 82 may receive feedback from a temperature sensor configured to sense the temperature of the freeze-protected fluid flowing within independent loop 32. In these embodiments, control circuitry 82 may operate chiller 12 in the second mode of operation until the temperature of the freeze-protected fluid exceeds or approaches the temperature of the cooling fluid. Control circuitry 82 may then switch chiller 12 to the third mode of operation that employs independent circuit 32 of free cooling system 28 to remove heat from refrigeration system 26. For example, control circuitry 82 may set valve 42 to bypass free cooling system 28.

The control circuitry may be based on various types of control logic that uses input from temperature sensors 84 and 86. Control circuitry 82 also may control other valves and pumps included within the chiller 12. Further, additional inputs such as flow rates, pressures, and other temperature may be used in controlling the operation of chiller 12. For example, other devices may be included in chiller 12, such as additional pressure and/or temperature transducers or switches that sense temperatures and pressures of the refrigerant and cooling fluid, the heat exchangers, the inlet and outlet air, and so forth. Further, the examples provided for determining the mode of operation are not intended to be limiting. Other values and set points based on a variety of factors such as system capacity, cooling load, and the like may be used to switch chiller 12 between the first, second, and third modes of operation.

The pump and valve configurations included in FIG. 2 are shown by way of example only and are not intended to be limiting. For example, the locations, numbers, and types of pumps and valves may vary. In one example, a pump may be included within circuit 30 to circulate the cooling fluid through free cooling system 28. In this example, pump 40 may be located within cooling fluid loop 24 upstream or downstream of valve 44. In another example, pump 62 may be located at other locations within independent loop 32, for example, upstream of valve 52 or downstream of air-to-liquid heat exchanger 34. Further, in certain embodiments, valve 44 may be eliminated, if, for example, a pump with a positive shutoff feature is included within circuit 30. In another example, pumps 62 may be equipped with positive shutoff features and valve 64 may be eliminated. In yet another example, valve 44 may be located at connection point 46. Further, valve 44 may be replaced by a two-way valve. For example, in one embodiment, a two-way valve may be located between connection points 44 and 46. Of course, many other pump and valve configurations may be envisaged and employed in chiller 12. Moreover, in other embodiments, the bypass valve 52, the connection point 58, and/or the check valve 64 may be omitted. In these embodiments, the freeze-protected fluid within the independent loop 32 may not bypass air-to-liquid heat exchanger 34. Moreover, in these embodiments, additional design features and/or equipment may be included to inhibit natural convection in the independent loop 32, which in turn may reduce freezing problems in heat exchanger 36. For example, a positive displacement pump may be included in independent loop 32 and/or heat exchanger 36 may be located at a high point within the independent loop 32.

Figure 3:
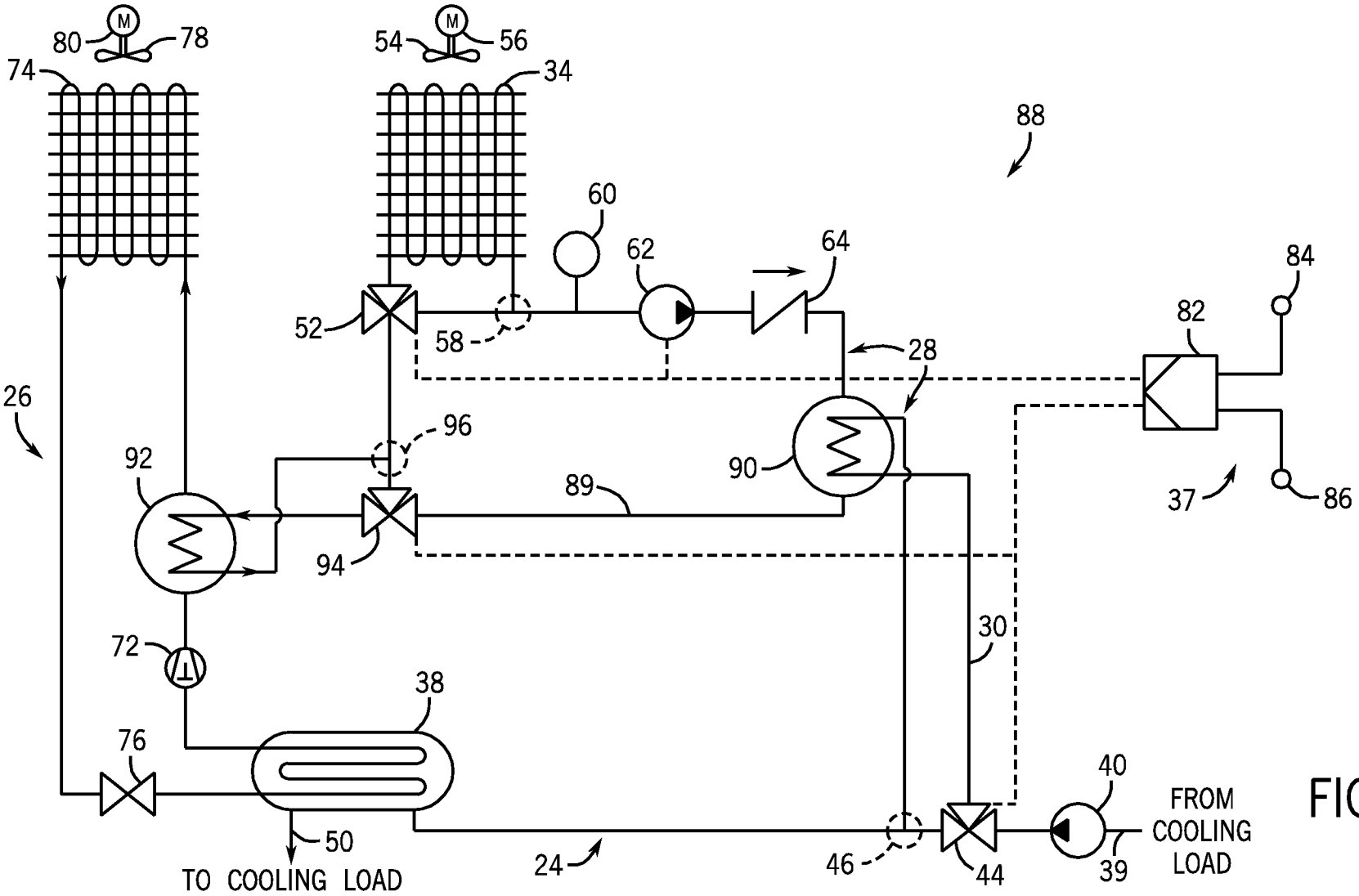
FIG. 3 is a diagrammatical overview of an embodiment of a free cooling refrigeration system employing two heat exchangers.

FIG. 3 illustrates another exemplary chiller 88 that includes cooling fluid loop 24, refrigeration system loop 26, and free cooling system 28. However, instead of including an independent loop 32 that circulates a freeze-protected fluid to a three-fluid heat exchanger 36 as shown in FIG. 2, free cooling system 28 includes an independent loop 89 that circulates a freeze-protected fluid between two heat exchangers 90 and 92. Heat exchangers 90 and 92 may be plate heat exchangers, shell and tube heat exchangers, plate and shell heat exchangers, or other suitable types of heat exchangers.

As described above with respect to FIG. 2, control devices 37 may switch chiller 88 between the first, second, and third modes of operation. Specifically, in the first mode of operation, control circuitry 82 may set valve 44 to direct the cooling fluid through circuit 30. Within circuit 30, the cooling fluid may flow through heat exchanger 90 and transfer heat to the freeze-protected fluid flowing through independent loop 89. The cooling fluid may then return to cooling fluid loop 24 through connection point 46 and flow through evaporator 38, which, as described above with respect to FIG. 2, may function as a reservoir without providing any substantial evaporative cooling. Supply line 50 may then circulate the cooling fluid to the cooling load.

As the freeze-protected fluid flows through heat exchanger 90, the freeze-protected fluid may absorb heat from the cooling fluid within heat exchanger 90. From heat exchanger 90, the freeze-protected fluid may circulate within independent loop 89 to a valve 94. In this first mode of operation, control circuitry 82 may set valve 94 to direct the freeze-protected fluid through connection point 96, bypassing heat exchanger 92. The freeze-protected fluid may then flow through valve 52, air-to-liquid heat exchanger 34, expansion tank 60, pump 62, and valve 64, as described above with respect to FIG. 2, before returning to heat exchanger 90. However, in other embodiments, valve 64 may be omitted and the freeze-protected fluid may flow through heat exchanger 92, which in this first mode of operation may function as a receiver for the freeze-protected fluid.

In the second mode of operation, control devices 37 may operate refrigeration system 26 as described above with respect to FIG. 2. The cooling fluid may flow through circuit 30 of free cooling system 28 to transfer heat to the freeze-protected fluid circulating within independent loop 89. The cooling fluid, after being cooled by the freeze-protected fluid, may flow through connection point 46 and re-enter fluid cooling loop 24. The cooling fluid may then flow into evaporator 38 where it may be cooled by refrigerant from refrigeration system 26.

Within refrigeration system 26, the refrigerant may circulate through a closed loop including compressor 72, heat exchanger 92, condenser 74, and expansion device 76. As the refrigerant flows through heat exchanger 92, the refrigerant may transfer heat to the freeze-protected fluid flowing within heat exchanger 92 from independent loop 89. Specifically, control circuitry 82 may set valve 94 of independent loop 89 to direct the freeze-protected fluid through heat exchanger 92. As the freeze-protected fluid flows through heat exchanger 92, the freeze-protected fluid may absorb heat from the refrigerant flowing within heat exchanger 92. In certain embodiments, the freeze-protected fluid may desuperheat a portion of, or all of, the refrigerant flowing through heat exchanger 36. The freeze-protected fluid may then flow through connection point 96 and valve 52 to air-to-liquid heat exchanger 34 where the freeze-protected fluid may transfer heat to the ambient air. Accordingly, in the second mode of operation, the freeze-protected fluid may absorb heat from the cooling fluid flowing within loop 24 and the refrigerant flowing within refrigeration system loop 26. However, in other embodiments a bypass valve 94 may allow the freeze protected fluid to bypass the heat exchanger 92 and flow directly to valve 52 in the second mode of operation.

In the third mode of operation, control circuitry 82 may set valve 44 to bypass circuit 30. Accordingly, the cooling fluid may flow from valve 44 directly to connection point 46, bypassing free cooling system 28. From connection point 46, the cooling fluid may flow through evaporator 38 where it may be cooled by the refrigerant flowing through refrigeration system 26.

Free cooling system 28 may then provide supplemental cooling for refrigeration system 26. Specifically, the freeze-protected fluid may flow through independent loop 89 of free cooling system 28 as previously described with respect to the second mode of operation. However, in this third mode of operation, as the freeze-protected fluid flows through heat exchanger 92, the freeze-protected fluid may absorb heat from the compressed refrigerant exiting compressor 72 and flowing through heat exchanger 92. In certain embodiments, heat exchanger 92 may function to desuperheat the compressed refrigerant before it enters condenser 74. By transferring heat from the refrigerant to the freeze-protected fluid flowing within independent loop 89 of free cooling system 28, heat exchanger 92 may provide additional cooling capacity for refrigeration system 26. In other embodiments, the refrigeration system 26 may not include a condenser 74. In these embodiments, the heat exchanger 92 may function as a condenser.

Figure 4:
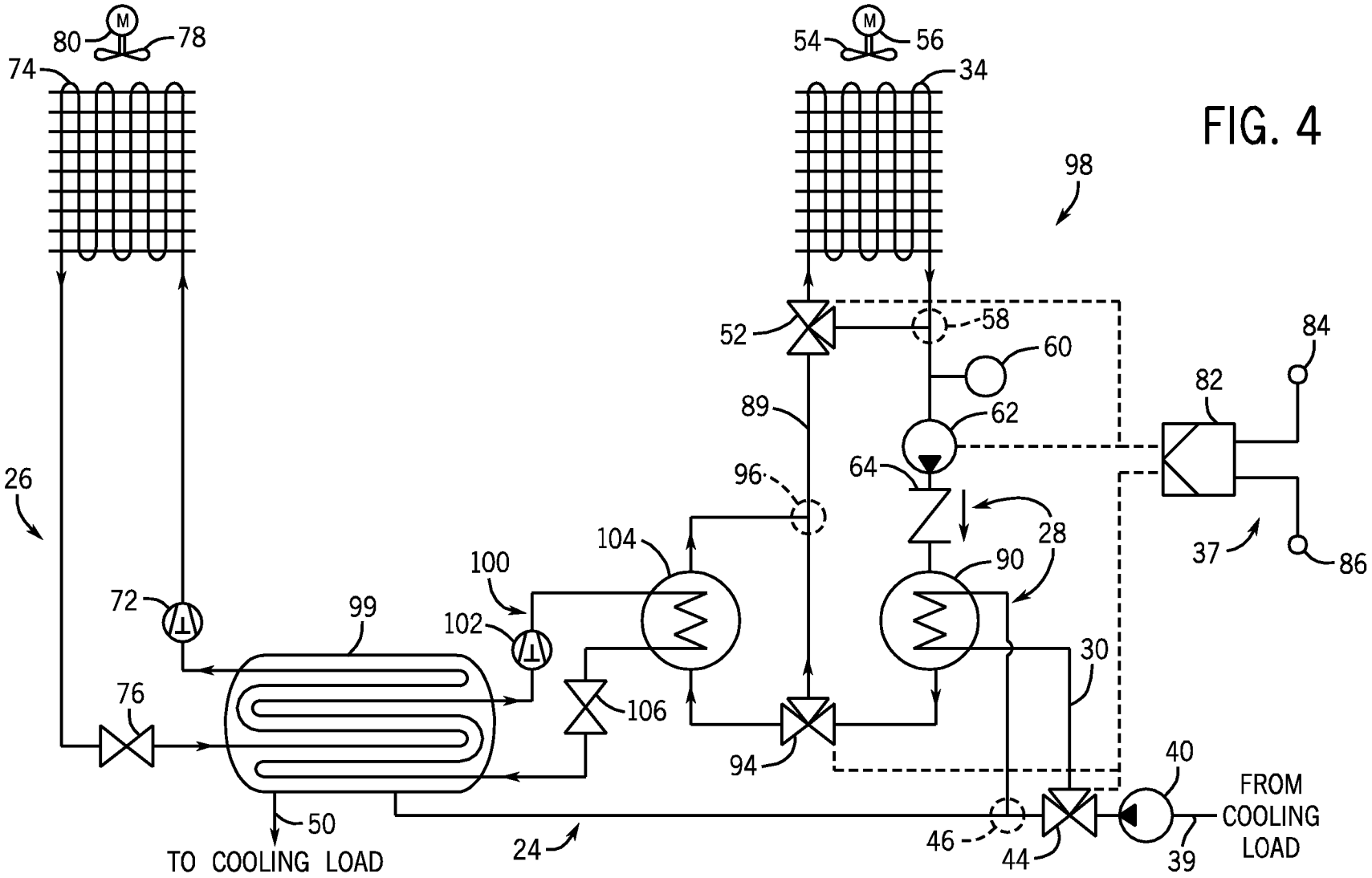
FIG. 4 is a diagrammatical overview of another embodiment of a free cooling refrigeration system employing two heat exchangers.

FIG. 4 illustrates another chiller 98 that includes cooling fluid loop 24, refrigeration system loop 26, and free cooling system 28. However, instead of evaporator 38 (FIG. 3), chiller 98 may include a three-fluid heat exchanger 99. Heat exchanger 99 may circulate refrigerant from a second refrigeration system loop 100 in addition to circulating the cooling fluid from cooling fluid loop 24 and the refrigerant from refrigeration system loop 26. In certain embodiments, heat exchanger 99 may be a shell and tube heat exchanger with multiple circuits or a plate heat exchanger with multiple circuits.

As described above with respect to FIG. 2, control devices 37 may switch chiller 98 between the first, second, and third modes of operation. Specifically, in the first mode of operation, control circuitry 82 may set valve 44 to direct the cooling fluid through circuit 30 where the cooling fluid may transfer heat to the freeze-protected fluid flowing through independent loop 89 as described above with respect to FIG. 3. The cooling fluid may then flow through connection point 46 and re-enter cooling fluid loop 24. From connection point 46, the cooling fluid may flow through heat exchanger 99, which in this first mode of operation, may function as a reservoir without providing any substantial cooling of the cooling fluid. Although refrigeration system loops 26 and 100 may not operate during the first mode of operation, heat exchanger 99 may act as a receiver for the refrigerant within these two loops 26 and 100. From heat exchanger 99, the cooling fluid may return to the cooling load through a supply line 50.

In the second mode of operation, control devices 37 may operate refrigeration system 26 as described above with respect to FIG. 2. The cooling fluid may flow through circuit 30 of free cooling system 28 to transfer heat to the freeze-protected fluid circulating within independent loop 89. The cooling fluid, after being cooled by the freeze-protected fluid, may flow through connection point 46 and re-enter fluid cooling loop 24. The cooling fluid may then flow into heat exchanger 99 where it may be cooled by refrigerant from refrigeration system 26. Specifically, the refrigerant circulating within refrigeration system loop 26 may absorb heat from the cooling fluid as the refrigerant flows through heat exchanger 99. In this second mode of operation, refrigeration system loop 100 still may not operate; however, heat exchanger 99 may act as a receiver for the refrigerant within loop 100.

In the third mode of operation, control circuitry 82 may operate refrigeration system loop 100 in addition to operating refrigeration system loop 26. In certain embodiments, control circuitry 82 may enable a compressor 102 of refrigeration system loop 100. Refrigeration system loop 100 may circulate the refrigerant through a heat exchanger 104 that also circulates the freeze-protected fluid flowing within independent loop 89. For example, control circuitry 82 may set valve 94 to direct the freeze-protected fluid from valve 94 to heat exchanger 104. As the freeze-protected fluid flows through heat exchanger 104, the freeze-protected fluid may absorb heat from the refrigerant of refrigeration system loop 100. The freeze-protected fluid may then release the heat to the ambient air as the freeze-protected fluid flows through air-to-liquid heat exchanger 34, as described above with respect to FIG. 3.

Control circuitry also may set valve 44 to bypass circuit 30. Accordingly, the cooling fluid may flow from valve 44 directly to connection point 46, bypassing free cooling system 28. From connection point 46, the cooling fluid may flow through heat exchanger 99 where it may be cooled by refrigerant flowing through refrigeration systems 26 and 100. Refrigeration system 26 may operate as described above with respect to FIG. 2.

Refrigeration system 100 may implement a vapor-compression cycle, or other type of cooling cycle, such as absorption or a thermoelectric cycle, to provide additional cooling for the cooling load. Within refrigeration system 100, the refrigerant may circulate through a closed loop including a compressor 102, heat exchanger 104, and an expansion device 106. In operation, the refrigerant may exit heat exchanger 99 as a low pressure and temperature vapor. Compressor 102 may reduce the volume available for the refrigerant vapor, consequently, increasing the pressure and temperature of the vapor refrigerant. The compressor may be any suitable compressor, such as a screw compressor, reciprocating compressor, rotary compressor, swing link compressor, scroll compressor, or centrifugal compressor. The compressor 102 may be driven by a motor that receives power from a variable speed drive or a direct AC or DC power source.

From compressor 102, the high pressure and temperature vapor refrigerant may flow through heat exchanger 104. Heat exchanger 104 may be plate heat exchanger, shell and tube heat exchanger, plate and shell heat exchanger, or other suitable type of heat exchanger. As the refrigerant flows through heat exchanger 104, the refrigerant may transfer heat to the freeze-protected fluid flowing within heat exchanger 104 from independent loop 89. The freeze-protected fluid may then release the heat to the ambient air through air-to-liquid heat exchanger 34. In this manner, the free cooling system 28 may be employed to provide additional cooling of the cooling fluid during the third mode of operation.

Within heat exchanger 104, the refrigerant vapor may condense into a liquid as the refrigerant transfers heat to the freeze-protected fluid. The liquid refrigerant then enters an expansion device 106 where the refrigerant expands to become a low pressure and temperature liquid-vapor mixture. Typically, expansion device 106 will be a thermal expansion valve (TXV); however, according to other exemplary embodiments, the expansion device may be an electromechanical valve, an orifice, or a capillary tube. From expansion device 106, the liquid refrigerant may enter heat exchanger 99 where the process may begin again, and the refrigerant may absorb heat from the cooling fluid flowing through heat exchanger 99.

Accordingly, during the third mode of operation, two refrigeration systems 26 and 100 may be employed to provide cooling capacity for the cooling fluid loop 24. Each refrigeration system 26 and 100 may release heat to the ambient air. Specifically, refrigeration system 26 may release heat through condenser 74 and refrigeration system 100 may release heat to the freeze-protected fluid in independent loop 89, which in turn may release heat to the ambient air through air-to-liquid heat exchanger 34.

Of course, the pump and valve configurations included in FIGS. 3 and 4 are shown by way of example only and are not intended to be limiting. For example, the locations, numbers, and types of pumps and valves may vary. In one example, a pump may be included within independent loop 89 downstream of valve 94. In another example, pumps with positive shutoff features may be included instead of valve 94. Moreover, any of the pump and valve variations described above with respect to FIG. 2 may be employed in FIGS. 3 and 4.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes that fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A cooling system comprising:

a free cooling system;

a circuit of the free cooling system configured to receive a first cooling fluid from a cooling fluid loop and pass the first cooling fluid through a first heat exchanger along the circuit and back to the cooling fluid loop, wherein the first heat exchanger is configured to facilitate heat transfer from the first cooling fluid to a second cooling fluid;

a first refrigeration system configured to circulate a first refrigerant through a second heat exchanger;

an independent loop of the free cooling system configured to circulate the second cooling fluid from the first heat exchanger to the second heat exchanger and from the second heat exchanger to a first air-to-liquid heat exchanger, wherein the first air-to-liquid heat exchanger is configured to transfer heat from the second cooling fluid to ambient air and the second heat exchanger is configured to facilitate heat transfer from the first refrigerant to the second cooling fluid;

a third heat exchanger configured to receive the first cooling fluid from the cooling fluid loop, the first refrigerant, and a second refrigerant, wherein the first cooling fluid, the first refrigerant, and the second refrigerant are separate from one another in the third heat exchanger, and wherein the third heat exchanger is configured to receive the first cooling fluid from the cooling fluid loop in a first mode of system operation and in a second mode of system operation;

a second refrigeration system configured to circulate the second refrigerant from the third heat exchanger to a second air-to-liquid heat exchanger, wherein the second air-to-liquid heat exchanger is configured to transfer heat from the second refrigerant to the ambient air;

a first valve disposed along the cooling fluid loop and configured to selectively direct the first cooling fluid to bypass the free cooling system in the first mode of system operation and to sequentially direct the first cooling fluid from a cooling load to the first heat exchanger along the circuit of the free cooling system, from the first heat exchanger along the circuit of the free cooling system to the third heat exchanger, and from the third heat exchanger back to the cooling load in the second mode of system operation;

a second valve disposed along the independent loop and configured to enable a flow of the second cooling fluid through the first air-to-liquid heat exchanger in a first position and to block the flow of the second cooling fluid through the first air-to-liquid heat exchanger in a second position; and a controller configured to adjust the second valve between the first position and the second position based on feedback received from an ambient temperature sensor.

2. The cooling system of claim 1, wherein the second cooling fluid comprises a freeze-protected fluid.

3. The cooling system of claim 1, wherein the second refrigeration system is a vapor-compression cycle.

4. The cooling system of claim 3, wherein the second refrigeration system comprises:

a compressor configured to compress the second refrigerant;

the second air-to-liquid heat exchanger configured to receive and to condense the compressed second refrigerant; and an expansion device configured to reduce pressure of the condensed second refrigerant before the second refrigerant enters the third heat exchanger.

5. The cooling system of claim 1, wherein the first refrigeration system is a vapor-compression cycle configured to absorb heat from the first cooling fluid.

6. The cooling system of claim 1, wherein the third heat exchanger comprises a three-fluid heat exchanger.

7. The cooling system of claim 1, comprising a third valve disposed along the independent loop of the free cooling system and configured to selectively direct the second cooling fluid to the second heat exchanger in a first free cooling mode of operation and to bypass the second heat exchanger in a second free cooling mode of operation.

8. The cooling system of claim 1, comprising an expansion tank disposed along the independent loop and configured to receive the second cooling fluid from the second valve, the first air-to-liquid heat exchanger, or both, wherein the expansion tank is configured to enable storage and thermal expansion of the second cooling fluid in the independent loop.

9. A refrigeration system comprising:

a free cooling system;

a heat exchanger;

a circuit of the free cooling system configured to circulate a first cooling fluid from a first cooling fluid loop through the heat exchanger to facilitate heat exchange between the first cooling fluid and a second cooling fluid and back to the first cooling fluid loop;

an independent loop of the free cooling system configured to circulate the second cooling fluid through the heat exchanger, wherein the independent loop circulates the second cooling fluid through an air-to-liquid heat exchanger configured to transfer heat from the second cooling fluid to ambient air;

a refrigeration loop configured to circulate a refrigerant through the heat exchanger on a high-pressure side of the refrigeration loop and a condenser disposed downstream of the heat exchanger, the refrigeration loop comprising an evaporator configured to form a direct heat exchange relationship between the refrigerant in the refrigeration loop upstream of the heat exchanger and the first cooling fluid directed sequentially from the heat exchanger to the evaporator, wherein the circuit of the free cooling system is configured to circulate the first cooling fluid directly from the heat exchanger to the evaporator through an uninterrupted conduit; and a controller configured to selectively direct the first cooling fluid to bypass the free cooling system based on a sensed temperature of ambient air.

10. The refrigeration system of claim 9, wherein the first cooling fluid has a first freezing point temperature, and wherein the second cooling fluid comprises a solution with a second freezing point temperature lower than the first freezing point temperature.

11. The refrigeration system of claim 9, comprising a control valve disposed along the first cooling fluid loop, wherein the controller is configured to operate the control valve to selectively direct the first cooling fluid to bypass the free cooling system during certain modes of operation.

12. The refrigeration system of claim 11, wherein the controller is configured to operate an additional control valve to selectively direct the second cooling fluid to the heat exchanger and bypass the air-to-liquid heat exchanger.

13. The refrigeration system of claim 11, wherein the controller is configured to selectively direct the first cooling fluid to the free cooling system based on the sensed temperature of the ambient air.

14. The refrigeration system of claim 9, wherein the controller is configured to selectively direct the second cooling fluid to bypass the air-to-liquid heat exchanger based on a sensed temperature of the first cooling fluid, the second cooling fluid, or both.

15. The refrigeration system of claim 9, wherein the heat exchanger comprises a three-fluid heat exchanger.

16. The refrigeration system of claim 9, wherein the heat exchanger is configured to receive the second cooling fluid into a shell side and configured to receive the first cooling fluid and the refrigerant into respective tubes.

* * * * *